US005277562A

United States Patent [19]

Fukuhara et al.

[11] Patent Number: 5,277,562

[45] Date of Patent: Jan. 11, 1994

[54] SCROLL FLUID MACHINE AND PRODUCING METHOD FOR THE SAME

[75] Inventors: Hiroyuki Fukuhara, Otsu; Shigeru Muramatsu; Hiroyuki Masunaga, both of Kusatsu, all of Japan

[73] Assignee: Matsushita Electric Industrial Co., Ltd., Osaka, Japan

[21] Appl. No.: 944,123

[22] Filed: Sep. 11, 1992

[30] Foreign Application Priority Data

Sep. 17, 1991 [JP] Japan ..... 3-235995

[51] Int. Cl.[5] ..... F01C 1/02; F01C 1/063

[52] U.S. Cl. ..... 418/55.2; 418/179; 29/527.5; 29/888.02

[58] Field of Search ..... 418/55.2, 179; 29/888.02, 527.5; 164/138, 70.1

[56] References Cited

U.S. PATENT DOCUMENTS 4,875,839 10/1989 Sakata et al. ..... 29/888.02
5,122,040 6/1992 Fields ..... 29/888.02
5,131,827 7/1992 Tasaka ..... 418/55.2

*Primary Examiner*—Richard A. Bertsch
*Assistant Examiner*—Charles G. Freay
*Attorney, Agent, or Firm*—Stevens, Davis, Miller & Mosher

[57] ABSTRACT

A scroll blade of a scroll fluid machine is formed of eutectic graphite cast iron in whose structure the average value of the largest eutectic shell is not more than one fourth of the height of a lap of the scroll blade. The scroll blade material thus formed will facilitate increasing working precision and reducing the number of working steps.

10 Claims, 4 Drawing Sheets

SCROLL FLUID MACHINE AND PRODUCING METHOD FOR THE SAME

BACKGROUND OF THE INVENTION

In recent years, there is a growing demand for a method of producing scroll fluid machines which method improves working precision and reduces the period of time required for working.

FIG. 6 illustrates a scroll compressor which is one kind of scroll fluid machine. A scroll blade 11 of the scroll compressor is generally formed of cast iron or steel to obtain a required strength, and is formed mainly by cutting (machining) through an end mill etc., to meet a required precision. In many cases, scroll blades are formed by using spheroidal graphite cast iron and by cutting through an end mill used for as the finish-working thereof.

Since a scroll blade has a complicated shape as shown in FIG. 3 and must be formed with a high precision, it usually takes a very long time to work it, e.g., cut it by means of an end mill. Therefore, in order to reduce the production costs of a scroll fluid machine, it is necessary to produce scroll blade with a low cost.

To reduce the period of time required to form a scroll blade, it is necessary to increase the cutting rate of a working such as that of an end mill. The cutting rate can be increased by increasing the cutting amount per rotation of the tool and/or by increasing the rotational speed of the tool.

Since increasing of the cutting amount per rotation of a tool such as an end mill generally causes reduction of working precision, the cutting amount per rotation cannot be substantially increased in the production of scroll blades, which requires a high working precision. Therefore, in the production process of scroll blades, the rotational speed of a cutting tool such as an end mill must be increased in order to reduce the period of time and the number of steps necessary to form a scroll blade. However, if a cutting tool is used at an increased rotational speed, the service life of the tool is reduced, which means an increase in the period of time and the number of steps due to the exchange of cutting tools during production of scroll blades, resulting in a low productivity. In practice, an appropriate balance between the working precision and the time necessary to produce a scroll blade is sought to reduce the production costs of the scroll blade.

Similarly, in a case where castings are used to form scroll blades, the period of time and the number of steps necessary to work-finish a scroll blade are significant and, therefore, productivity is low. In general, a well-balanced working regarding all of the working precision, the period of working time and the volume to be machining-removed is important to reduce the production costs of a scroll blade.

SUMMARY OF THE INVENTION

An object of the present invention is to obtain a scroll fluid machine and a method of producing the same in which both a high working precision and shortening of production steps for scroll blades are achieved to thereby reduce production costs thereof.

The above object is achieved by the following means:

1) Using a scroll blade made of eutectic graphite cast iron having good cutability, the average value of the width of the largest eutectic shell being not more than one fourth of the height of the lap of the scroll blade;

2) Using a scroll blade made of eutectic graphite cast iron having good cutability, the average value of the width of the largest eutectic shell is not more than one fourth of the height of the lap of the scroll blade, the scroll blade being formed through a casting process in which a metal mold is used. Further, by selecting the material of a mold, the scroll blade material is cast to have a shape appropriating to a finishing shape so that the volume of cast material removal effected by cutting is minimized; and 3) Using a scroll blade made of eutectic graphite cast iron having good cutability, the average value of the width of the largest eutectic shell is not more than one fourth of the height of the lap of the scroll blade, the scroll blade being formed through a sand mold. Further, by selecting a casting process, the scroll blade material is cast to have a shape approximating to a finishing shape so that the volume of cast material removal effected by cutting after the casting is mixmized.

The above-shown means makes it possible to obtain a scroll fluid machine explained below.

FIG. 1 is a vertical sectional view showing the structure of a scroll blade 1 made of eutectic graphite cast iron, which scroll blade comprises an end plate portion 1 and a lap portion 2 protruded from the end plate portion 1.

In general, since eutectic graphite cast iron has fine graphite particles uniformly dispersed, it has a good cutability. Thus, because of its good cutability, eutectic graphite cast iron is widely used to form most of cylinders of rolling piston fluid machines. However, on the boundaries 4 (dark or black portion) of the eutectic shell, pearlite of a high hardness precipitates, with the result that, when it is cut mainly by an end mill, undulation occurs due to a hardness difference between the pearlite and other portions 3 to thereby make it impossible to obtain high precision. In the present invention there is used an eutectic graphite cast iron in which the average value of the width of the largest eutectic shell is not more than one fourth of the height of the lap of the scroll blade so that the undulations caused by the structure hardnesses difference in the direction of the height of the lap is made uniform, whereby it becomes possible to obtain a scroll blade of a high cutting precision.

Further, since eutectic graphite cast iron has good cutability when machined by an end mill or the like, the rotational speed of the cutting tool of an end mill etc. can be increased in the present invention so as to reduce the period of time required for the cutting step, without substantially reducing the service life of the cutting tool.

A scroll blade is required to have a high strength because the walls of the lap thereof receive large pressures during operation of the scroll fluid machine. Thus, in the present invention, pearlite 4 is precipitated in such a degree a not to degrade the cutability of the cast iron which cutability is needed during cutting by end mill etc., so that the strength of the lap can be enhanced. More specifically, to obtain such structure of eutectic graphite cast iron as providing both sufficient strength and good cutability at the time of machining by an end mill or the like, the amount of pearlite is controlled to be in a range from 7 to 30%.

In a scroll fluid machine such as a compressor shown in FIG. 6, the height of the lap of the scroll blade is generally in a range from 10 to 30 mm. In such a scroll blade, special conditions are needed to obtain a structure of eutectic graphite cast iron in which the average value of the largest eutectic shell is one fourth of the height of the lap or less.

As one of such special conditions, the amounts of carbon and silicon contained in eutectic graphite cast iron are needed to be as close to the eutectic range as possible. Appropriate amounts of carbon and silicon are 2.0 to 4.5%, 1.0 to 4.0%, respectively. Preferably, 0.05 to 1.3% of Ti is added to promote the growth of the eutectic structure. Further, since the sizes of eutectic shells are substantially determined by the cooling rate after casting, in the present invention there is used a method of producing a scroll blade which method employs a metal mold bringing about such a high cooling rate as to obtain the particular structure of eutectic graphite cast iron.

In a case of using a metal mold, a simple shape as shown in FIG. 2 can be easily obtained, but a complicated shape as shown in FIG. 3 cannot easily be obtained because a metal mold is likely to thermally deform so that the casting is apt to stick to the inside of the metal mold. To solve such a problem, the present invention provides a method of producing a scroll blade which method uses a metal mold cooled by water and formed of a copper alloy to have a shape approximated to the finished shape of the scroll blade. By using a mold having a shape approximated to the finished shape of the scroll blade, the volume to be cut-removed from the scroll blade material is reduced, thus reducing the number of processing steps. In addition, since graphite particles are uniformly dispersed in the structure of eutectic graphite cast iron with small distances between the graphite grains, the cutability thereof necessary at the time of cutting by means of an end mill or the like can be increased. Thus, a scroll blade can be produced at an increased rate and with a high precision.

The present invention provides another method of forming a scroll blade in which method the scroll blade material of eutectic graphite cast iron shown above is formed by using a mold formed of graphite into a shape approximated to the finished shape of the scroll blade.

The present invention provides still another method of forming a scroll blade in which method the scroll blade material of eutectic graphite cast as described above is formed by adjusting chemical composition and by using a sand mold.

A shell mold process may be employed to form a mold having a shape more approximated to the finished shape of the scroll blade.

Further, the present invention provides another method in which a scroll blade material of eutectic graphite cast iron explained above is formed by using a mold having a shape approximated to the finished shape of the scroll blade which mold is formed by a lost wax process.

By using a mold having a shape approximated to the finished shape of the scroll blade, the volume to be removed from a casting corresponding to the scroll blade is reduced, thus reducing the number of processing steps. Further, the graphte particles are uniformly dispersed in the structure of eutectic graphite cast iron with small distances between the graphite particles, the cutability thereof necessary at the time of cutting by means of an end mill or the like can be increased. Thus, a scroll blade can be produced at an increased rate and with a high precision.

Further objects, features and advantages of the present invention will become apparent from the following description of the preferred embodiments with reference to the attached drawings.

DESCRIPTION OF THE PREFERRED EMBODIMENTS

Figure 6:
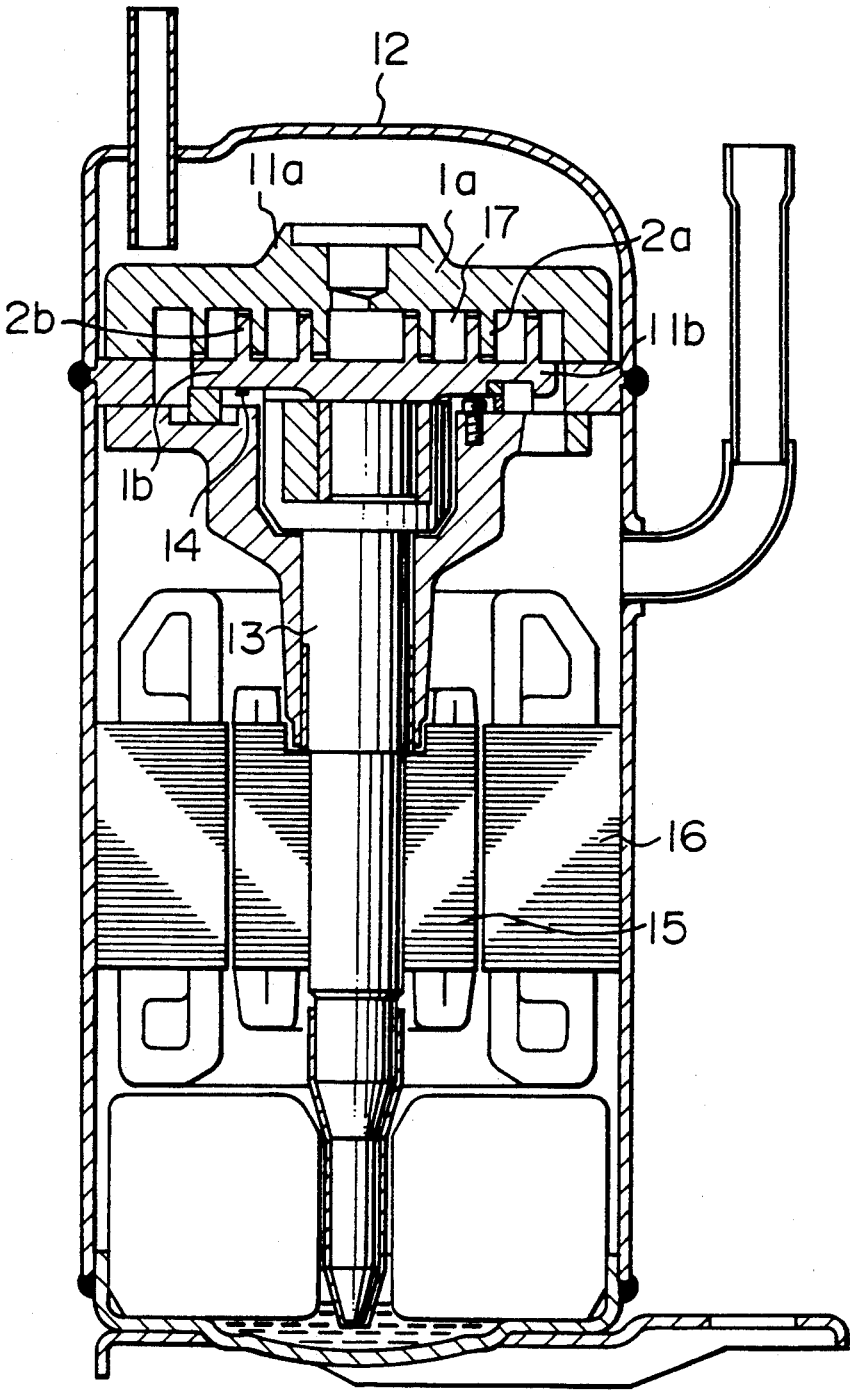
FIG. 6 is a sectional view of a scroll fluid machine.

The construction and operation of a scroll compressor shown in FIG. 6 is first explained. In FIG. 6 a hermetic shell 12 includes therein a fixed scroll blade 11*a*, a orbiting scroll blade 11*b*, a crank shaft 13, a rotor 15 of an electric driving unit, and a stator 16. The fixed and orbiting scroll blades 11*a* and 11*b* comprise scroll end plates 1*a*, 1*b* and scroll laps 2*a*, 2*b*, respectively.

The scroll compressor thus constructed is operated as follows. The crank shaft 13 is rotated by rotation of rotor 15. The rotating crank shaft 13 causes the orbiting scroll blade 11*b* to orbit. If rotation of the crank shaft 13 is directly transmitted to the scroll blade 11*b*, the scroll blade 11*b* will rotate without orbiting. However, in the compressor a rotation preventing means (stator) 16 is provided for converting rotation of the crank shaft 15 into orbiting motion of the scroll blade 11*b*. The coolant is compressed by this orbiting motion of the scroll blade 11*b*. More specifically, as the scroll blade 11*b* orbits, the volume of compression gaps 17 defined between the scroll lap 2*b* of the orbiting scroll blade 11*b* and the scroll lap 2*a* of the scroll blade 11*a* is gradually decreased toward the center portion of the scroll blades 11*a* and 11*b*, with the result that a coolant in the compression rooms 17 is thus compressed.

Next, the scroll blades, which are the essential portions of the present invention, will be described.

Figure 1:
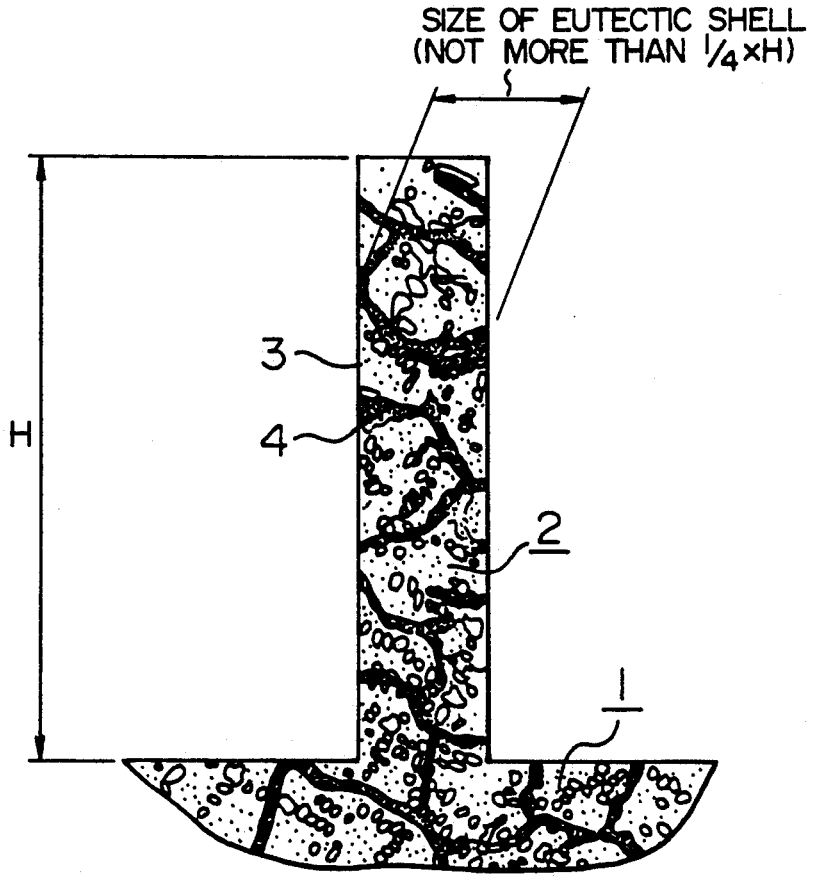
FIG. 1 is a schematic sectional view of the lap of a scroll blade according to an embodiment of the present invention.

FIG. 1 shows a schematic sectional view of the structure of a scroll blade according to an embodiment of the present invention. The scroll blade is made of eutectic graphite cast iron and comprises an end plate portion 1 and a lap portion 2 protruded therefrom. The average value of the largest eutectic shell is not more then one fourth of the height (H) of the lap 2.

Figure 2:
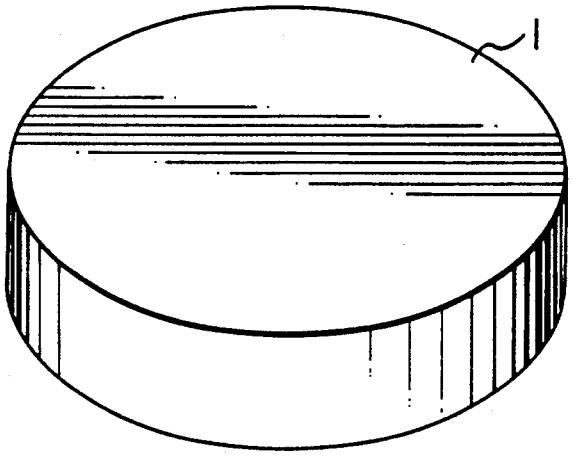
FIG. 2 is a perspective view of a casting from which a scroll blade is formed.

FIG. 2 illustrates a casting for a scroll blade, which casting is not yet machined into the scroll blade. The casting from which a scroll blade is to be machined is formed using a metal mold or sand mold.

Figure 3:
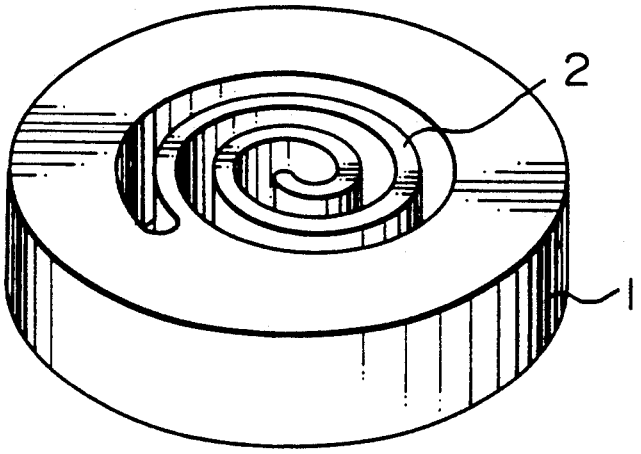
FIG. 3 is a perspective view of a scroll blade according to another embodiment of the present invention.

FIG. 3 illustrates a scroll blade 1 as cast according to another embodiment. The as-cast scroll blade 1 according to this embodiment is formed of eutectic graphite cast iron by using a mold made of a copper alloy or graphite and having a shape approximated to the finished shape of the scroll blade. Therefore, the as-cast scroll blade shown in FIG. 3 has a shape approximated to the finished shape of the scroll blade. The as-cast scroll blade having a shape approximated to the finished shape of the scroll blade product may also be made of eutectic graphte cast iron obtained by adjusting the chemical composition, by using a shell mold process or lost wax process in which a mold has a shape approximated to the finished shape of the scroll blade.

Figure 4:
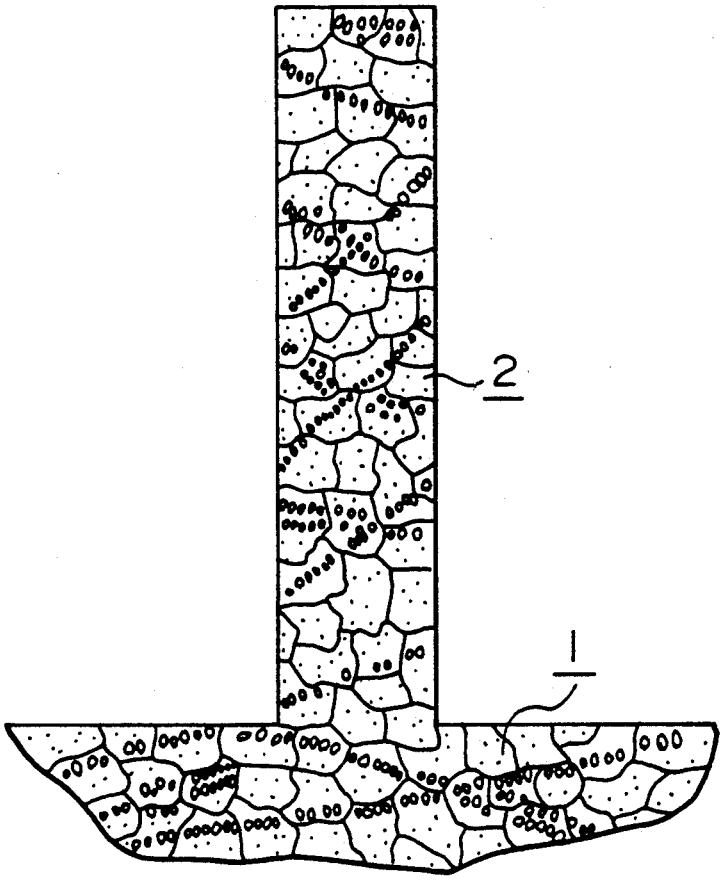
FIG. 4 is a schematic sectional view of a scroll blade formed by using a mold made of a copper alloy or graphite.
Figure 5:
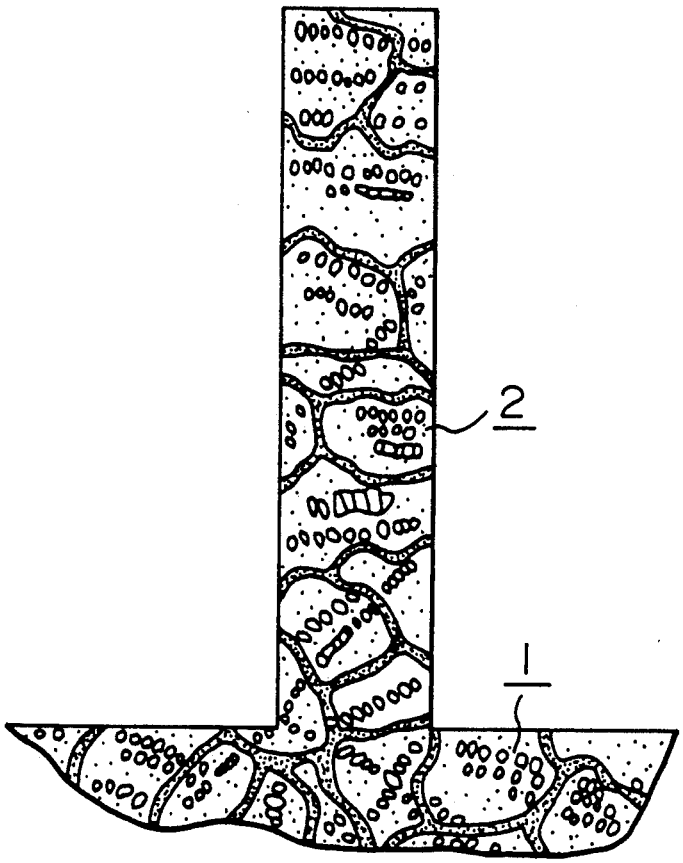
FIG. 5 is a schematic sectional view of a scroll blade formed by using a sand mold, the scroll blade having eutectic structure obtained by adjusting the chemical composition.

FIG. 4 shows a schematic sectional view of the lap 2 of a scroll blade 11 formed by using a mold made of a copper alloy or graphite, as described above. In this case, since the scroll blade as-cast has been cooled at a large rate, it has fine eutectic shell structure. FIG. 5 shows a sectional view of the lap of a scroll blade 11 made of eutectic graphite cast iron obtained by adjusting the chemical composition and by using a shell mold or lost wax process in which a sand mold is used, the resultant eutectic shell structure has a relatively large width.

According to the present invention, since eutectic graphite cast iron is used as a scroll blade material, the period of time required when cutting the scroll blade material, e.g., by using an end mill, can be reduced without substantially reducing the service life of the cutting tool such as that of an end mill, so that the production costs of a scroll blade of a scroll fluid machine can be substantially reduced. Further, since the average value of the largest eutectic shell is controlled so as to be not more than one fourth of the height of the lap of the scroll blade, undulations apt to occur on the structure due to hardness difference is minimized to thereby make it possible to effect machining with an increased precision.

Further, since in the invention a scroll blade as-cast having a complicated shape can be formed by using a metal mold made of a copper alloy or graphite or the like and by employing a casting process such as the shell mold process or the lost wax process, the volume to be machine-removed from the as-cast scroll blade in the process to finish the scroll blade is reduced. Therefore, the number of steps can be reduced, thus reducing the production costs of a scroll blade of a scroll fluid machine.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A scroll fluid machine comprising a scroll blade having an end plate portion and a lap portion protruded from said end plate portion, said scroll blade being made of eutectic graphite cast iron having eutectic shells, the average value of the largest eutectic shell being not more than one fourth of the height of said lap portion.

2. A scroll fluid machine including a scroll blade according to claim 1, wherein said eutectic graphite cast iron consisting, by weight, of 0.05 to 1.3% Ti, 2.0 to 4.5% C, 1.0 to 4.0% Si, the balance iron and incidental impurities.

3. A scroll fluid machine comprising a scroll blade according to claim 1, wherein the volume of pearlite distributed in matrix of the eutectic graphite cast iron is in a range of 7 to 30% by volume.

4. A method of producing a scroll fluid machine comprising a scroll blade having an end plate and a lap portion protruded from said end plate, comprising the step of forming said blade by use of eutectic graphite cast iron by using a metal mold so that the average value of the largest eutectic shell is not more than one fourth of the height of said lap portion.

5. A method of producing a scroll fluid machine according to claim 4, wherein said metal mold is formed of a copper alloy and has a shape approximated to the finished shape of the scroll blade.

6. A method of producing a scroll fluid machine according to claim 4, wherein said metal is formed of a graphite and has a shape approximated to the finished shape of the scroll blade.

7. A method of producing a scroll fluid machine comprising a scroll blade having an end plate portion and a lap portion, comprising the step of forming the scroll blade by use of eutectic graphite cast iron containing 0.05 to 1.3% of Ti through a sand mold, the average value of the largest eutectic shell being not more than one fourth of the height of said lap portion.

8. A method of producing a scroll fluid machine according to claim 7, wherein said mold is formed by a shell mold process and has a shape approximated to the finished shape of the scroll blade.

9. A method of producing a scroll fluid machine according to claim 7, wherein said mold is formed by a lost wax process and has a shape approximated to the finished shape of the scroll blade.

10. A method of producing a scroll fluid machine including a scroll blade comprising shells and having an end plate and a lap portion protruding from said end plate, said method comprising:

forming said blade of eutectic graphite cast iron such that an average value of a largest one of said shells is not more than one fourth a height of said lap portion.

* * * * *